US007915506B2

(12) United States Patent
Jacob

(10) Patent No.: US 7,915,506 B2
(45) Date of Patent: Mar. 29, 2011

(54) ELECTRONIC GUITAR HARNESS COMPONENT CONNECTOR

(76) Inventor: Bruce Ledley Jacob, Laurel, MD (US)

( * ) Notice: Subject to any disclaimer, the term of this patent is extended or adjusted under 35 U.S.C. 154(b) by 0 days.

(21) Appl. No.: 12/854,166

(22) Filed: Aug. 10, 2010

(65) Prior Publication Data

US 2011/0034069 A1 Feb. 10, 2011

Related U.S. Application Data

(60) Provisional application No. 61/232,652, filed on Aug. 10, 2009.

(51) Int. Cl.
*G10D 3/00* (2006.01)

(52) U.S. Cl. ..... 84/327

(58) Field of Classification Search ..... 84/327, 84/329

See application file for complete search history.

(56) References Cited

U.S. PATENT DOCUMENTS 4,715,259 A * 12/1987 Wittman ..... 84/327

* cited by examiner

*Primary Examiner* — Kimberly R Lockett
(74) *Attorney, Agent, or Firm* — Timothy P. Monaghan, Esq.

(57) ABSTRACT

An electronic guitar harness component connector uses ribbon cables and circuit boards to interconnect electronic components in an electric guitar harness. The use of ribbon cables and circuit boards to interconnect electronic components in the harness solves the problem of hand-soldered joints of discrete wires. It eliminates the need for the hand-soldered joints of discrete wires, and multiple wires. Discrete wires are replaced with a single ribbon cable and/or circuit boards to interconnect electronic components.

22 Claims, 9 Drawing Sheets

2 HUMBUCKER, 2 VOLUME, 2 TONE, 3WAY SWITCH

ELECTRONIC GUITAR HARNESS COMPONENT CONNECTOR

CROSS-REFERENCE TO RELATED PATENTS

The present application claims the benefit of the provisional application 61/232,652 filed Aug. 10, 1009.

FIELD

The present invention relates to the wiring of electronic components in an electric guitar. More specifically, the invention relates to the use of a ribbon cables and circuit boards to interconnect electronic components in the electronic system in an electric guitar harness.

BACKGROUND OF THE INVENTION

An electric guitar "harness" is the term of art for the electronic components of an electric guitar, i.e., the circuitry accessed in the rear of the guitar, including electric components like the pickups, switches, potentiometers, and output jacks.

The industry trend in electric guitar and bass guitar designs has been to increase electronic complexity of the harness. These complex circuits require more electronic components, more complicated wiring between electronic components, and overall more complex harnesses that involve multiple wires connecting the individual components.

Using discrete, individual wires in the harness causes numerous problems. In manufacturing multiple hand-soldered joints, or soldering discrete wires, is a potential failure. In effect, three hands are needed to make a reliable solder joint. One hand holds the wire to the component, another hand holds the soldering iron to the wire and the component; and the last hand touches the solder to the heated wire and component. However, a single person solders the wires, using only two hands, and so the quality of the solder joint is a potential failure. The result is often cold-solder joints, i.e., solder joints with cracks in the metal lattice. The cold-solder joint exhibits intermittent electrical failures, or in use, after numerous expansions and contractions, the solder joint fail altogether when the tiny cracks in the joint pull completely apart. Another problem is when discrete wires are connected by hand to one of many terminals. By simple human error wires are accidentally connected to the wrong terminal. Thus, the harness failure rate is increasing as the complexity of the circuitry increases.

Ribbon cables in active guitar systems (i.e., those with battery-powered electronics), and ribbon cable connections in passive components are also novel in the electric guitar and bass industry. The electric guitar industry continues to use the current standard discrete wire and hand-soldered joints described above.

OBJECTS AND SUMMARY OF THE INVENTION

The present invention solves the problem of hand-soldered joints of discrete wires by using a ribbon cable connector and/or other multi-wire connectors to connect electronic components in an electric guitar harness.

It is an object of the invention to eliminate the need for the hand-soldered joints of discrete wires, and multiple wires are replaced with a single ribbon cable.

It is yet another object of the invention to use a wide variety of ribbon cable connections to the harness where both ends of the ribbon cable have modular connectors that mate and manually snap into matching connectors on printed circuit boards.

It is also an object of the invention to use a ribbon cable and one end of the cable connects directly to electronic components of a circuit board while the other end of the cable has a modular snap-on connector that manually snaps into a matching connector on printed circuit boards.

It is yet another object of the invention to use of either of the above ribbon cable connection types (snap-on connectors or direct ribbon cable connection to the electronic circuit board) with a modular connectors also in the middle of the ribbon cable that manually snaps into a matching connector on printed circuit board.

Embodiments of the present invention overcome the difficulties described in the background of the invention because ribbon cables and other multi-wire cables with modular connectors connect in through-hole configurations on printed circuit boards. Thus, the cable's bared wires fit into holes designed expressly for that cable, and so the need for a separate hand to hold the cable to the circuit board is eliminated. The manufacturer need only hold a soldering iron and the solder, because the wires are held in place by design. Consequently, cold-solder joints are rare, and the electrical connections are extremely reliable, especially over time.

It is thus another object of the invention to relieve manufacturers from having to place each wire separately. In embodiments of the invention each of the wires in the ribbon cable and circuit boards connects to its mated wire automatically.

It is a further object of the invention to provide an efficient, small electronic component interconnection in the harness of electric guitars. Additionally, the wiring interconnection schemes of the invention are more efficient, effective system design than implementations with discrete wires. Also, trouble-shooting problems in a harness embodiments made of ribbon cables are far simpler than trouble-shooting problems in traditional discrete wire harnesses.

Other objects and advantages of the invention will appear from the following description of embodiments of the invention using a snap-on ribbon cable connector, other multi-wire connectors, and circuit boards to connect all electronic components in an electric guitar circuitry when considered in connection with the accompanying figures and the novel features particularly pointed out in the appended claims.

DESCRIPTION AND DISCUSSION OF EMBODIMENTS

A ribbon cable can connect any electrical points previously connected by discrete wires. A single ribbon cable, or a small set of ribbon cables, can replace all discrete wires in the harness. The use of ribbon cable connectors prevents the crossing of wires, erroneous connection points, and the cold-solder joints causing the single wire faults discussed above.

A ribbon cable is a series of thin, flat, insulated wires, arranged side by side and fastened together to form a flexible "ribbon" of wires, i.e., cables. The ribbon cable can have modular connectors at one or both ends (and also in the middle) and depending on placement of the modular connectors the ribbon cable connects components and/or printed circuit boards. For instance, if both ends of a ribbon cable have modular connectors they mate and manually snap into matching connectors on printed circuit boards. Alternately, the electronic components of the harness can connect directly to one side of the ribbon cable and one side can have modular connectors that the ribbon cable connects components and/or printed circuit boards. Thus, the invention foresees a wide variety of embodiments of ribbon cable connections to the harness.

Additionally, to decrease the failure rate, the modular connectors at either end of the cable are keyed or colored to ensure that they connect with the proper orientation, addressing the issue of connecting a wire to the wrong terminal. The connections from component terminals to the mating modular connector are on a circuit board, which also eliminates potential human error in connecting a wire to the wrong terminal. Thus, the possibility of wiring components incorrectly is reduced tremendously when using a ribbon cable.

Embodiments Used in Electric Guitar Harnesses of Increasing Complexity

Figure 1:
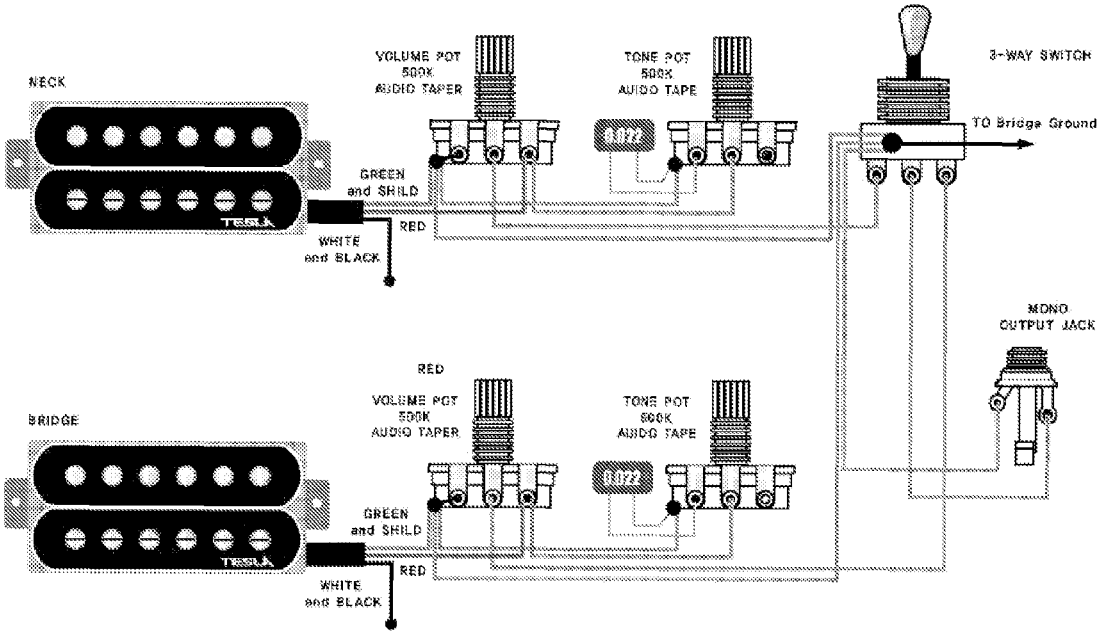
FIG. 1. Gibson Les Paul wiring, showing two humbucker pickups, two volume controls, two tone controls, a three-way pickup selector, and an output jack.

FIG. 1 shows the circuit diagram for a typical dual-humbucker guitar. This represents the type of circuit found in most Gibson Les Paul models and similar models with two humbucker pickups, two volume controls (one for each pickup), two tone controls (one for each pickup), and a three-way pickup selector. Each wire in the diagram represents a separate discrete wire, and each discrete wire represents one or two separate solder points. When discrete wires are soldered to components, cold-solder joints are common results, i.e., the three-hand analogy described above.

Figure 2:
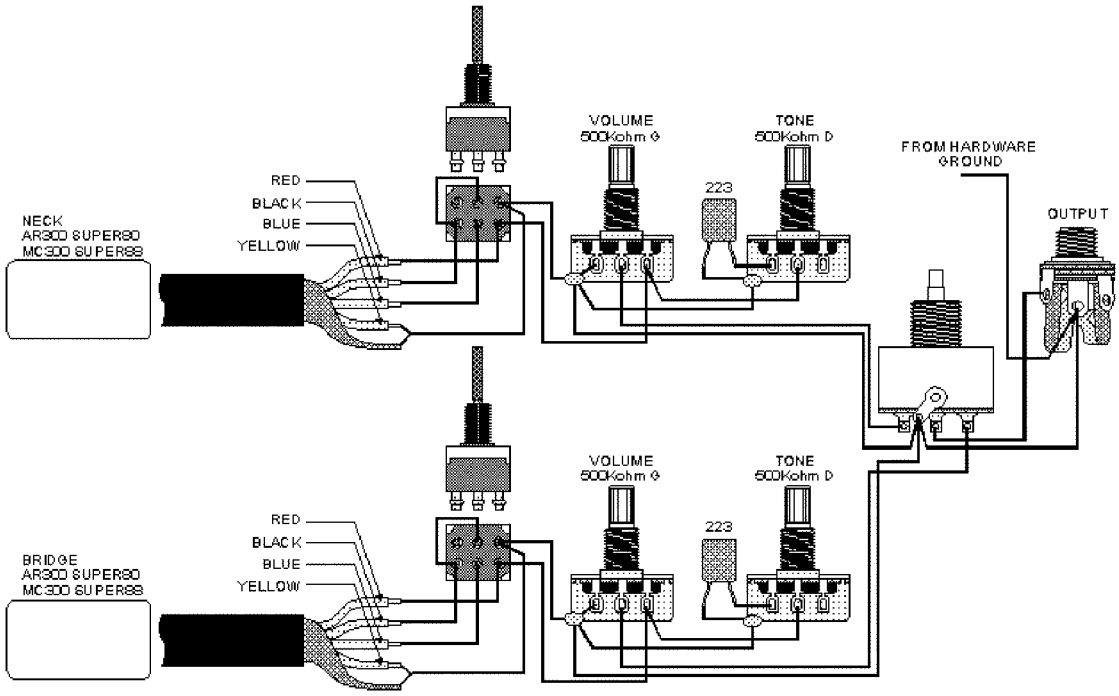
FIG. 2. Ibanez AR300 wiring, showing a more complex circuit based on the Les Paul arrangement.

FIG. 2 shows a more complex circuit based on the Les Paul arrangement. This is typical of modern enhancements to the base circuit design. In addition to the Les Paul controls (two volume controls, two tone controls, one pickup selector), the Ibanez AR300 guitar model adds two 3-way mini-toggle switches that put each of the humbucker pickups into different modes of pick-up topology (series, parallel, or single-coil). The number of wires in the FIG. 2 circuit is approximately double compared to the FIG. 1 Les Paul design.

The number of wires in a circuit grows exponentially as the number of circuit components are added to a circuit: in the worst case (if all components are connected to each other), the number of wires is $O(n^2)$, i.e. it grows as the square of the number of circuit components. Thus, in the worst case, if the number of components is increased by 40%, the number of wires is increased by 2×.

Figure 3:
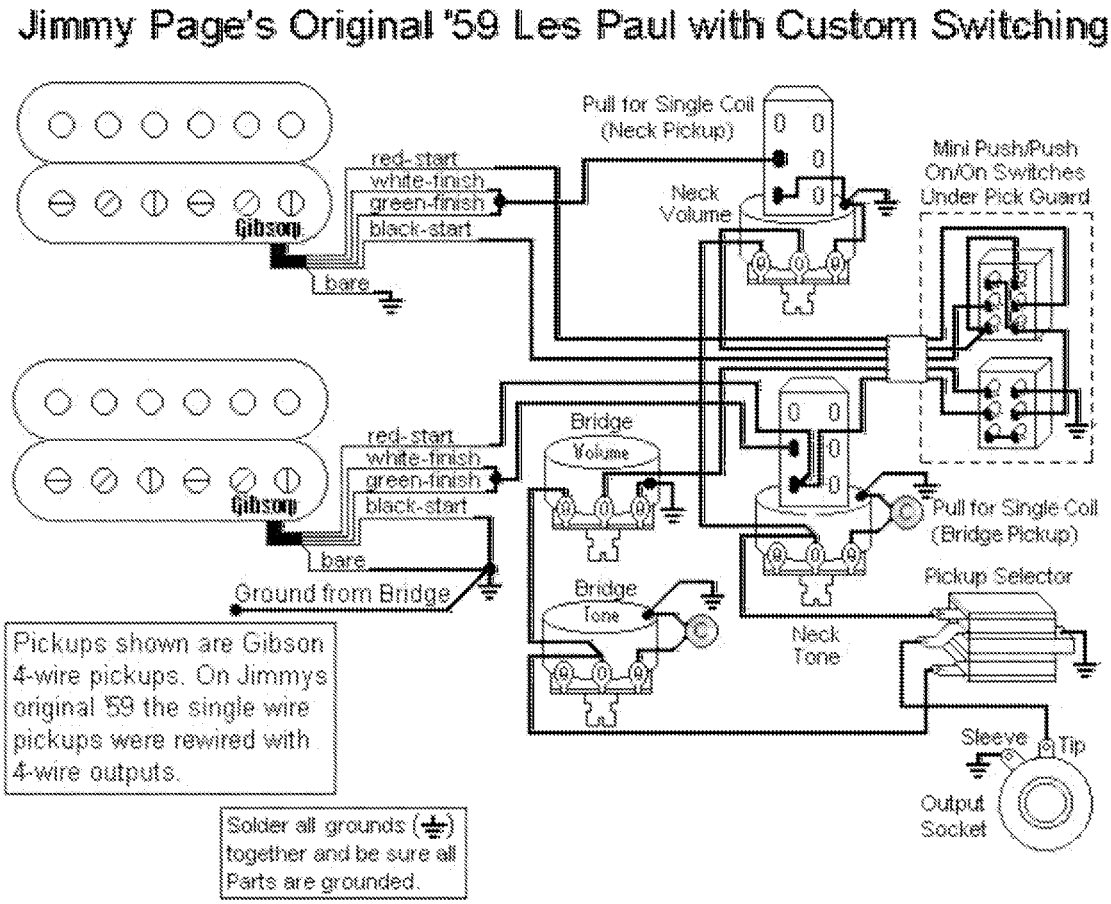
FIG. 3. The "Jimmy Page" modification of the Les Paul wiring, producing several dozen different tones using an additional four switches beyond the single 3-way pickup selector.

FIG. 3 shows the circuit diagram for the Jimmy Page modification, one of the most complex variations of the Les Paul design. Like the AR300 modification, the number of discrete wires is substantially larger than the wires in the original Les Paul diagram (note that in the figure, the ground wires are not shown explicitly). The Jimmy Page modification increases the number of discrete wires, and thus the number of solder joints compared to the original Les Paul circuit, by more than a factor of two.

Figure 4:
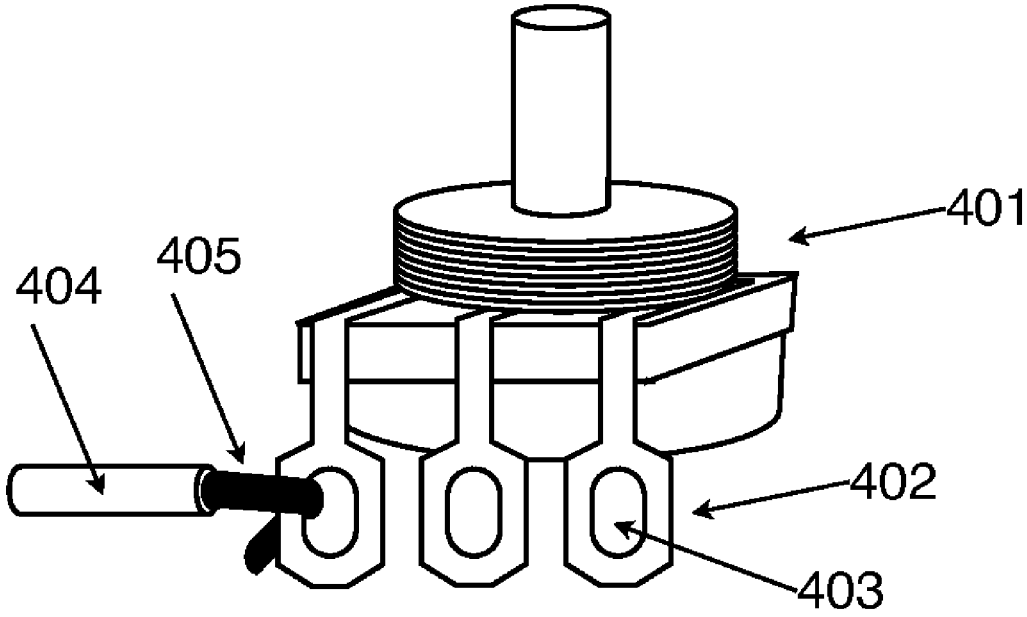
FIG. 4. A traditional potentiometer with solder-lug terminals, indicating a discrete-wire connection for soldering.

Embodiments of the Invention Simplifying the Harness Connectivity and Increasing Reliability FIG. 4 shows a potentiometer with solder-lug terminals. Each of the three terminals of the potentiometer has a hole in its end, to accommodate a bare wire inserted into it. The diagram shows a stripped wire with its bare end threaded into the open hole of a solder-lug terminal, and bent around the terminal. This approach of wrapping wires around the terminal simplifies the soldering of wires to the potentiometer by providing a greater degree of structural support than simply soldering the wire to the terminal.

Figure 5:
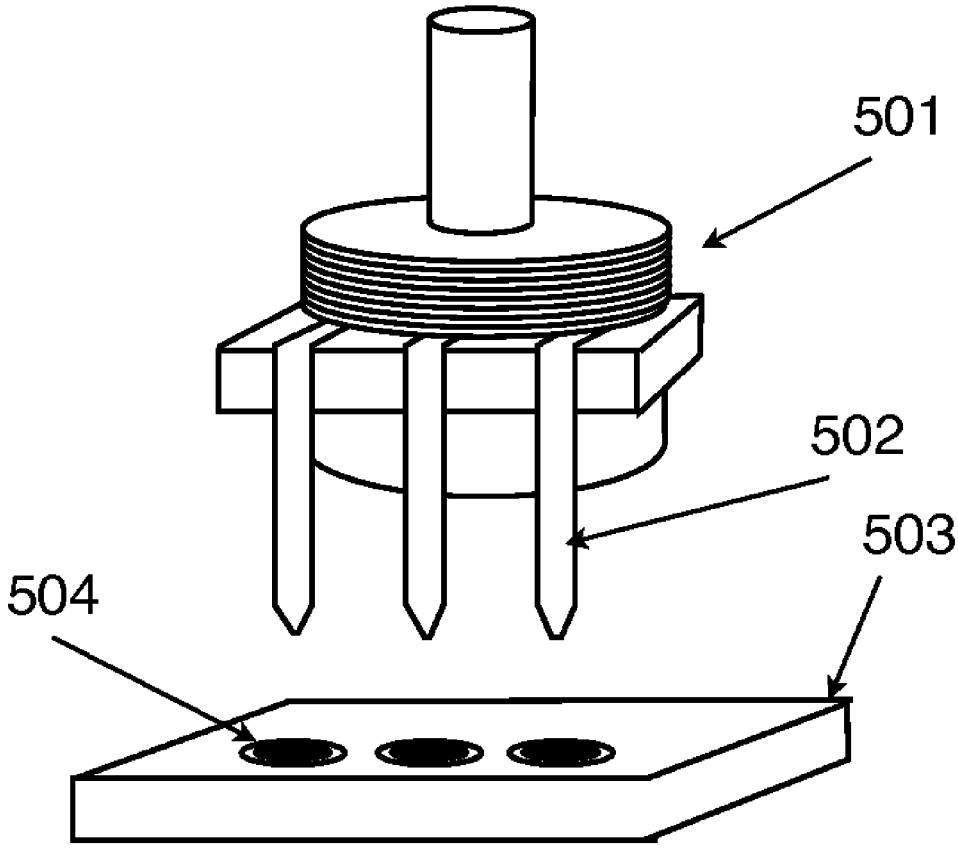
FIG. 5. A potentiometer with PCB-mount terminals. Each of the three terminals of the potentiometer is a slender piece of wire that is intended to go through holes in a circuit board and be soldered directly to that board.

Alternatively, FIG. 5 shows a potentiometer with PCB-mount terminals. (A printed circuit board (PCB) is used to mechanically support and electrically connect electronic components using conductive pathways, tracks or signal traces etched from copper sheets laminated onto a non-conductive substrate. A PCB terminal is a point of connection for two or more conductors in an electrical circuit.)

As opposed to the terminals in FIG. 4 that are designed to accommodate bare wires threaded through and attached to them, the PCB-mount terminals are intended to attach to a printed circuit board: the terminals are straight wires that are threaded through holes in a printed circuit board and are then soldered to the board. PCB-mount methods also include surface-mount technology wherein the terminal is soldered to an exposed patch of bare metal on the surface of the circuit board, as opposed to being threaded through the circuit board. For this embodiment, only thru-PCB mounting is illustrated, However, the invention is not limited to thru-PCB mounting, any PCB terminal connections work with the present invention.

A Ribbon-Cable and PCB-Mount Embodiment

Figure 6:
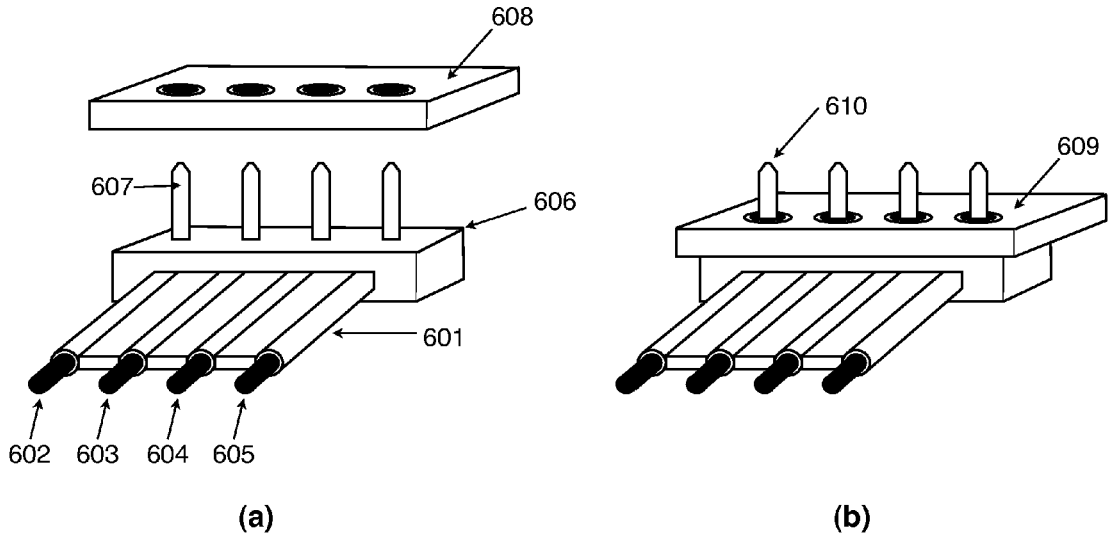
FIG. 6. A ribbon-cable assembly showing thru-PCB mounting.

FIG. 6 shows both the structure of a ribbon-cable assembly and the PCB-mount method of attaching a ribbon cable to a circuit board. Figure (a) shows the ribbon cable as a set of parallel wires. The ribbon cable ends in a modular connector that has one terminal for each wire in the ribbon cable—in the example, the ribbon cable has four parallel wires, and the modular connector has four terminals. Each terminal in the ribbon-cable connector is a slender piece of wire intended to go through a hole in a circuit board and is then soldered directly to that board. Above the ribbon-cable assembly is shown a circuit board with holes to accommodate the PCB-mount soldering. Note that the holes in the circuit board align with the terminal wires on the ribbon-cable connector (the same would be true if the mounting method were surface-mounting). Figure (b) shows the thru-PCB nature of mounting: the terminals of the ribbon-cable connector thread through the circuit board and extend slightly out the back side. These terminals are then soldered to the board, providing both solid structural support and reliable electrical connection. Note that this is identical in nature to the through-PCB mounting of a potentiometer; in general, in any type of PCB mounting, whether thru-hole or surface-mounting, the terminal wires are soldered to the circuit board, providing surface area for soldering and, once soldered, structural support as well.

Figure 7:
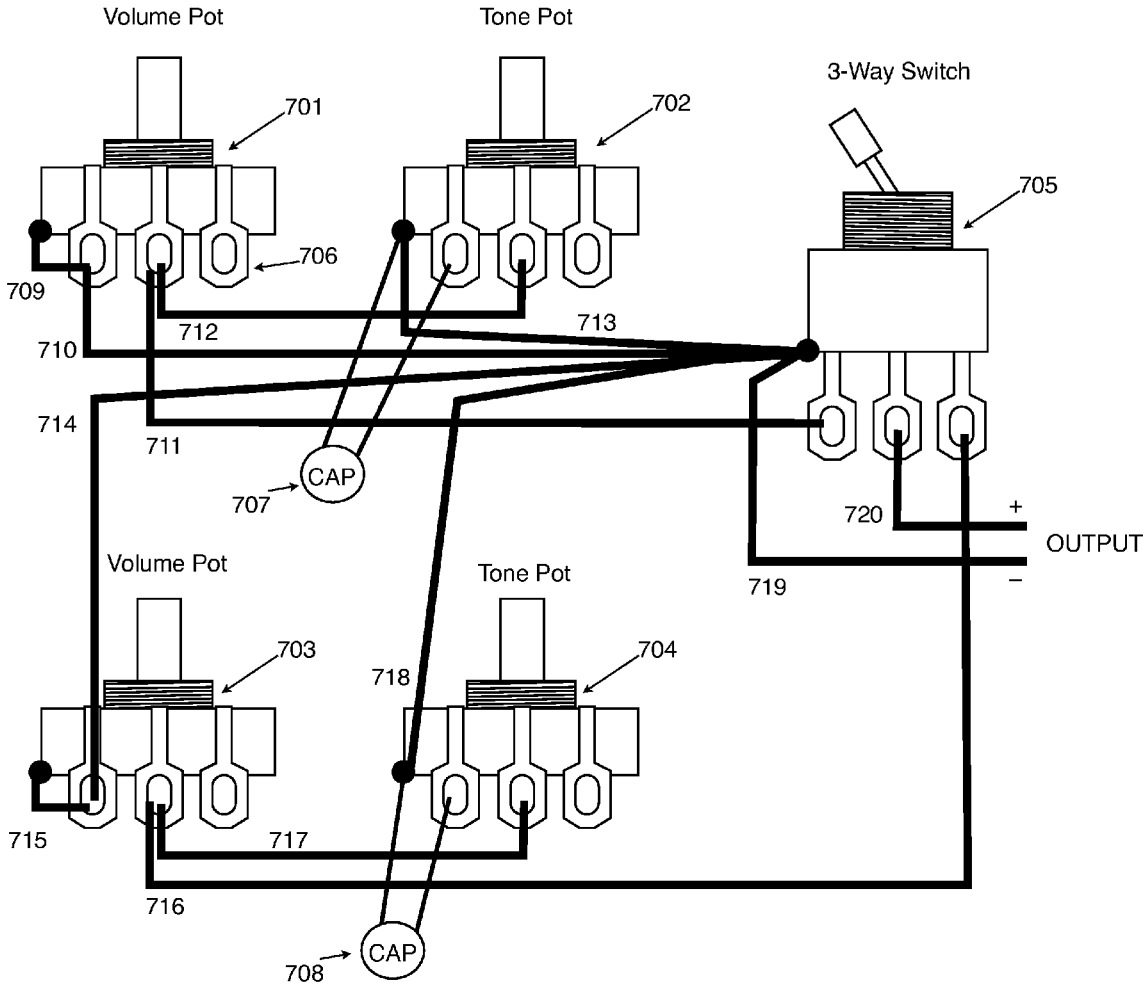
FIG. 7. A dual-humbucker wiring diagram using traditional harness construction.

FIG. 7 shows the circuit diagram for a generic dual-humbucker guitar; the figure illustrates the wiring harness including components between the guitar pickups and the output jack. Each dark black wire represents a discrete wire: i.e., an extent of hookup wire with ends bared and soldered to the indicated terminals. The two-tone capacitors are labeled "CAP". In this harness there are twelve (12) discrete hookup wires and sixteen (16) separate solder joints (some of which incorporate multiple wire connections). Including the four solder joints for the pickups and the two solder joints on the output jack, there is a total of twenty (20) solder joints in this harness.

Figure 8:
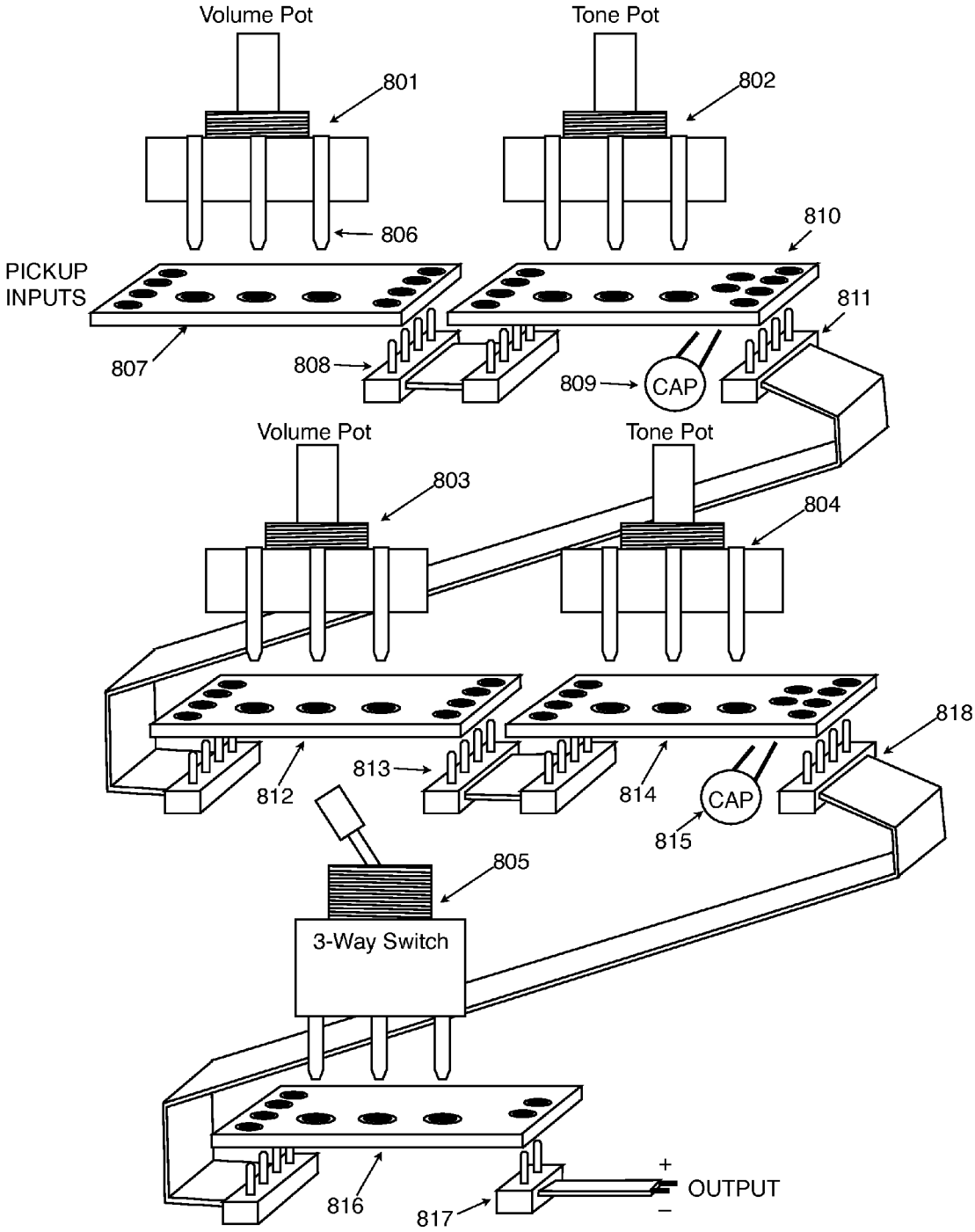
FIG. 8. A dual-humbucker block diagram for harness using circuit boards and ribbon cables.

FIG. 8 shows the block diagram for the same wiring harness as in FIG. 7, but implemented with ribbon cables and printed circuit boards instead of discrete wires. The discrete-wire solder joints that remain are the pickup connections, the capacitor connections, and the output jack. All other solder joints are PCB-mount connections, which are much more reliable. Instead of twelve (12) discrete wires connecting components and sixteen (16) discrete-wire solder joints, there are five (5) ribbon cables connecting the components, and four (4) discrete-wire solder joints, required for the two capacitors. If one includes the solder joints for the pickups and output jack, the number of discrete-wire solder joints in the entire guitar has been reduced to half: from twenty (20) to ten (10).

Figure 9:
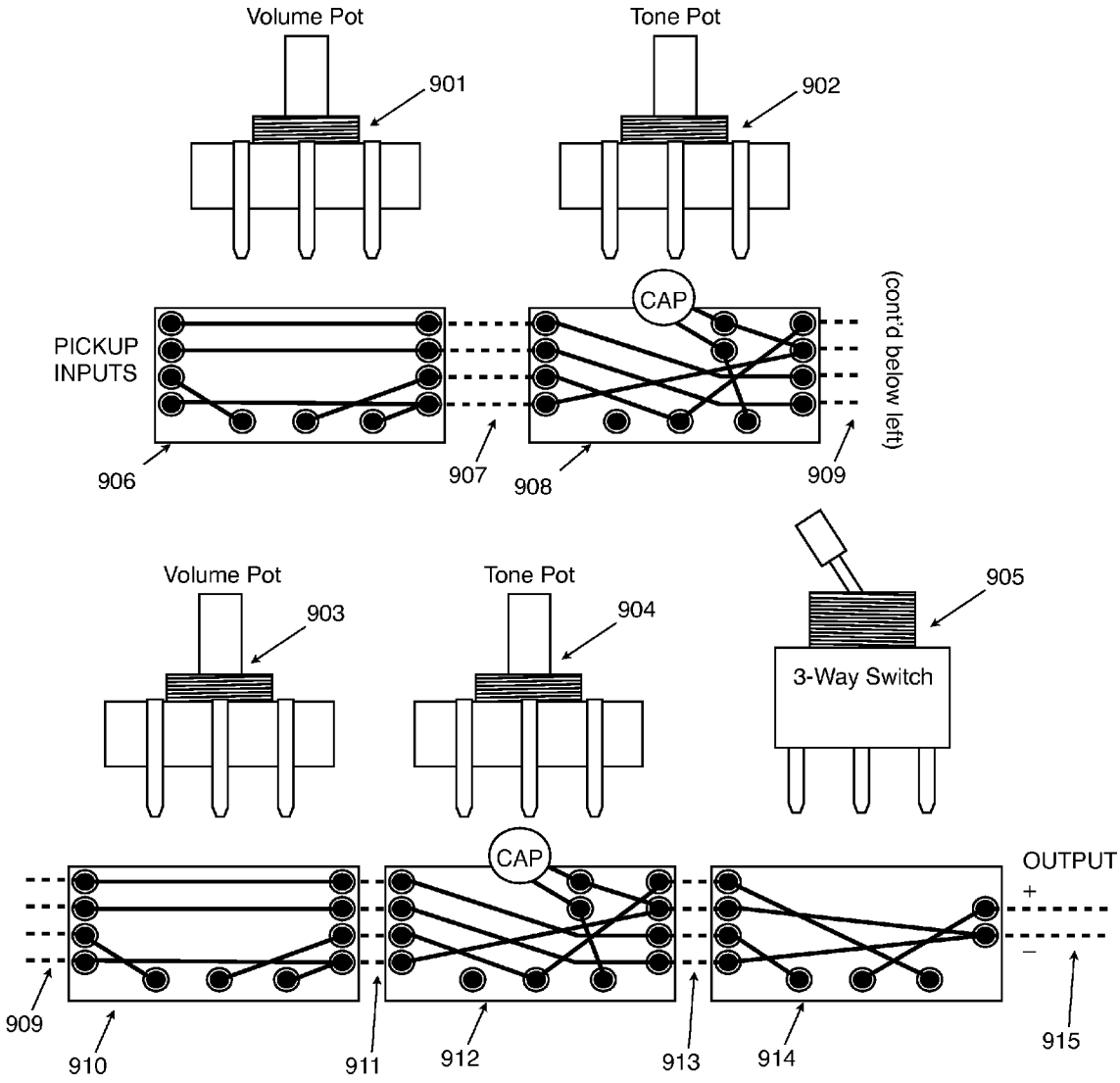
FIG. 9. A dual-humbucker circuit diagram for harness using circuit boards and ribbon cables. Ribbon cable connections are shown with dotted lines.

FIG. 9 shows the circuit diagram for the harness in FIG. 8; the connections on each PCB are shown, illustrating the entire circuit. For clarity, the ribbon cables are not shown explicitly, but instead their electrical connections are shown as dotted lines between components. The number of distinct objects (wires, components) in the harness is reduced substantially compared to the traditional wiring approach of FIG. 7. This simplification of the harness cleans up the control cavity, making the wiring in the back of the guitar more aesthetically pleasing and easier to debug, and the reduction in discrete-wire connections increases circuit reliability.

In conclusion, the discussion, Figures, and the discussion based on the Figures disclose a wide range of possible embodiments of the present invention. Thus, in general, a single component of ribbon cables or circuit boards can be replaced by multiple components, and multiple components replaced by a single component, to perform the disclosed use of a ribbon cables and circuit boards to interconnect electronic components in the electronic system in an electric guitar harness. Except where such substitution would not be operative to practice the invention, such substitution is within the scope of the present invention.

What is claimed is:

1. An electronic guitar harness component connector, having a ribbon cable having two ends, a first connector with a first snap-on adaptor on one end, a second connector with a snap-on adaptor on the other end, a first and a second set of electronics in a guitar harness, the first set of electronics having a mate to the snap-on adaptor of the ribbon cable, and the second set of electronics having a mate to the snap-on adaptor of the ribbon cable, whereby when the first ribbon cable snap-on adaptor is mated to the first mate of electronics, and the second ribbon cable snap-on adaptor is mated to the mate of the second set of electronics both sets of electronics are electrically coupled.

2. The electronic guitar harness component connector of claim 1 wherein the first end of the ribbon cable connects directly to the first set of electronics.

3. The electronic guitar harness component connector of claim 1 wherein the ribbon cable connects to a sub-set of electronic components in the guitar harness.

4. The electronic guitar harness component connector of claim 1 wherein the first and second snap-on adaptor are keyed to ensure that they connect with the proper orientation.

5. The electronic guitar harness component connector of claim 1 wherein the first and second snap-on adaptor are colored to ensure that they connect with the proper orientation.

6. The electronic guitar harness component connector of claim 1 wherein the ribbon cable has a snap-on adaptor approximately in the middle of the cable, and the first and second set of electronics has a third set of electronics, the third set having a mate to the snap-on adaptor of the ribbon cable, and the first, second and third ribbon cable snap-on adaptors mate and are electrically coupled to the first, second and third sets of electronics.

7. The electronic guitar harness component connector of claim 1 wherein the ribbon cable has modular connectors at one end.

8. The electronic guitar harness component connector of claim 1 wherein the ribbon cable has modular connectors at both ends.

9. The electronic guitar harness component connector of claim 1 wherein the ribbon cable has a modular connectors in the middle.

10. The electronic guitar harness component connector of claim 1 wherein the ribbon cable has modular connectors at both ends and in the middle.

11. The electronic guitar harness component connector of claim 1 wherein the ribbon cable connectors are multi-wire connectors.

12. An electronic guitar harness component connector, having a ribbon cable having two ends, a first connector with electrical terminals on one end, a second connector with electrical terminals on the other end, a first and a second set of electronics in a guitar harness, the first set of electronics having a mate to the first connector's terminals of the ribbon cable, and the second set of electronics having a mate to the second connector's terminals of the ribbon cable, whereby when the first ribbon cable connector is mated to the first mate of electronics, and the second ribbon cable connector is mated to the mate of the second set of electronics both sets of electronics are electrically coupled.

13. The electronic guitar harness component connector of claim 12 wherein the first end of the ribbon cable connects directly to the first set of electronics.

14. The electronic guitar harness component connector of claim 12 wherein the ribbon cable connects to a sub-set of electronic components in the guitar harness.

15. The electronic guitar harness component connector of claim 12 wherein the first and second snap-on adaptor are keyed to ensure that they connect with the proper orientation.

16. The electronic guitar harness component connector of claim 12 wherein the first and second snap-on adaptor are colored to ensure that they connect with the proper orientation.

17. The electronic guitar harness component connector of claim 12 wherein the ribbon cable has a snap-on adaptor approximately in the middle of the cable, and the first and second set of electronics has a third set of electronics, the third set having a mate to the snap-on adaptor of the ribbon cable, and the first, second and third ribbon cable snap-on adaptors mate and are electrically coupled to the first, second and third sets of electronics.

18. The electronic guitar harness component connector of claim 12 wherein the ribbon cable has modular connectors at one end.

19. The electronic guitar harness component connector of claim 12 wherein the ribbon cable has modular connectors at both ends.

20. The electronic guitar harness component connector of claim 12 wherein the ribbon cable has a modular connectors in the middle.

21. The electronic guitar harness component connector of claim 12 wherein the ribbon cable has modular connectors at both ends and in the middle.

22. The electronic guitar harness component connector of claim 12 wherein the ribbon cable connectors are multi-wire connectors.

* * * * *

UNITED STATES PATENT AND TRADEMARK OFFICE

CERTIFICATE OF CORRECTION

PATENT NO. : 7,915,506 B2
APPLICATION NO. : 12/854166
DATED : March 29, 2011
INVENTOR(S) : Bruce Jacob It is certified that error appears in the above-identified patent and that said Letters Patent is hereby corrected as shown below:

In the Specifications:

column 1 line 7, the year in the date reads “1009” should read “2009”

Signed and Sealed this
Twenty-ninth Day of November, 2011

David J. Kappos

David J. Kappos
*Director of the United States Patent and Trademark Office*